US006554640B1

(12) United States Patent
Koike et al.

(10) Patent No.: US 6,554,640 B1
(45) Date of Patent: Apr. 29, 2003

(54) RADIO COMMUNICATION EQUIPMENT HAVING A FLOATING CONNECTOR

(75) Inventors: Noboru Koike, Tokyo (JP); Yutaka Nakamura, Tokyo (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 1 day.

(21) Appl. No.: 09/584,084

(22) Filed: Jun. 1, 2000

(30) Foreign Application Priority Data

Jun. 2, 1999 (JP) ..... 11-155824

(51) Int. Cl.[7] ..... H01R 3/00

(52) U.S. Cl. ..... 439/500; 439/660; 439/862; 429/97; 429/98

(58) Field of Search ..... 439/500, 660, 439/65, 862, 66; 429/96, 97, 98, 100, 123

(56) References Cited

U.S. PATENT DOCUMENTS

| | | | | | |
|---|---|---|---|---|---|
| 3,960,434 | A | * | 6/1976 | Soes | 439/660 |
| 5,220,520 | A | * | 6/1993 | Kessoku | 439/500 |
| 5,317,247 | A | * | 5/1994 | Chong et al. | 439/500 |
| 5,387,134 | A | * | 2/1995 | Bryce et al. | 439/660 |
| 5,509,813 | A | * | 4/1996 | Lu | 439/500 |
| 5,607,791 | A | * | 3/1997 | Garcia et al. | 439/500 |
| 5,716,230 | A | * | 2/1998 | Marren et al. | 439/500 |

FOREIGN PATENT DOCUMENTS

| | | |
|---|---|---|
| JP | 4-126682 | 11/1992 |
| JP | 6-89709 | 3/1994 |
| JP | 6-29056 | 4/1994 |
| JP | 6-60052 | 8/1994 |
| JP | 8-279945 | 10/1996 |
| JP | 9-55785 | 2/1997 |

* cited by examiner

*Primary Examiner*—Tho D. Ta
(74) *Attorney, Agent, or Firm*—Finnegan, Henderson, Farabow, Garrett & Dunner, L.L.P.

(57) ABSTRACT

A radio communication equipment having a battery compartment and a battery pack provided in the battery compartment, the equipment including a first connector block having a female portion provided at the battery pack, and the first connector block having a first contact with a first contact portion and a second contact portion facing the first contact portion, and a second connector block having a male portion provided at the battery, and the second connector block having a second contact having elasticity with a third contact portion and a fourth contact portion facing the third contact portion, wherein the second connector block is engaged with the first connector block, and the third contact portion is pressed against the first contact portion and the fourth contact portion is pressed against the second contact portion by the elasticity of the second contact.

20 Claims, 10 Drawing Sheets

RADIO COMMUNICATION EQUIPMENT HAVING A FLOATING CONNECTOR

BACKGROUND OF THE INVENTION

1. Field of the Invention

The present invention relates to a radio communication equipment and more particularly to the structure of electrical connection between a housing of a radio communication equipment and a battery pack.

2. Description of the Related Art

The mainstream electrical connection between a telephone housing B and a battery pack C in a portable telephone (radio communication equipment) A comprising the battery pack C which is attached to the telephone housing B has been configured so that spring pins b provided in the telephone housing B contact face-to-face with terminals c provided in the battery pack C as shown in FIGS. 7 through 9.

However, the structure of contacting the spring pins b with the terminals c face-to-face has had a problem that because the position of the contact part of the spring pins b and terminals c is precisely defined in the state when the battery pack C is attached: to the telephone housing B, there has been a case when the spring pins b separate from the terminals c instantaneously, i.e., when a so-called instantaneous disconnection occurs, thus disconnecting the electrical connection, when an impact is given on the telephone housing B or the battery pack C.

Meanwhile, a personal handy phone (PHS) H shown in FIG. 10 comprises a housing I, a lid J and a battery pack K. The housing I is electrically connected with the battery pack K by engaging a connector k provided to the battery pack K via a harness h to a connector i provided in the housing I. Such structure causes no instantaneous disconnection as described above.

It is then conceivable to apply the structure of connection of the housing I and the battery pack K in the personal handy phone H described above to the structure of connection of the housing and the battery pack of the portable telephone.

However, although it is required to often replace the battery pack of the digital portable telephone for example in case of using it for business purposes because its continuous speakable time is around 120 minutes, the structure of connection of the personal handy phone cannot be adopted for that of the portable telephone from the aspect of its durability because the connectors i and k of the personal handy phone H are not designed to be used in the environment in which they are removed frequently and a durable removable number of times is only around 30 times.

Still more, because the connector k is attached to the harness h extending from the battery pack K in the personal handy phone H described above, there has been a possibility that not only the work for removing the connector k from the connector i of the housing I is complicated but also the harness h is unintentionally damaged and disconnected in carrying the battery pack K.

The applicant files an patent application (Japanese patent application No. 11-132543, U.S. patent application Ser. No. 09/314,148) that a floating connector with male and female connectors is provided in a battery pack and a portable telephone. However, a first contact of the male connector has only one contact portion contacting a second contact of the female connector. Therefore, it is impossible to prevent the instantaneous disconnection of electrical connection between the battery pack 10 and the portable telephone.

Accordingly, in view of the problems described above, it is an object of the invention to provide a radio communication equipment which is capable of preventing the instantaneous disconnection of the electrical connection between the housing and the battery pack in advance without leading to a drop of the durability and workability.

THE SUMMARY OF THE INVENTION achieve the object and advantage of the invention, there is provided a radio communication equipment having a battery compartment and a battery pack provided in the battery compartment, the equipment comprising a first connector block having a female portion provided at the battery pack, and the first connector block having a first contact with a first contact portion and a second contact portion facing the first contact portion, and a second connector block having a male portion provided at the battery, and the second connector block having a second contact having elasticity with a third contact portion and a fourth contact portion facing the third contact portion, wherein the second connector block is engaged with the first connector block, and the third contact portion is pressed against the first contact portion and the fourth contact portion is pressed against the second contact portion by the elastic of the second contact.

Further, there is provided a battery pack for use in a radio communication equipment with the battery compartment, the battery compartment provided with a male connector block having a contact, comprising a female connector block having a first contact with a first contact portion and a second contact portion facing the first contact portion, wherein the male connector block includes a second contact having elasticity with a third contact portion and a fourth contact portion, and when the male connector block is engaged with the female connector block, the third contact portion is pressed against the first contact portion and the fourth contact portion is pressed against the second contact portion by the elasticity of the second contact.

Furthermore, there is provided a connector for use in connecting a circuit of a radio communication equipment with a battery pack, the radio communication equipment having a battery compartment, the battery pack being provided in the battery compartment, the connector comprising a first connector block having a f female portion provided at the battery pack, and the first connector block having a first contact with a first contact portion and a second contact portion facing the first contact portion, and a second connector block having a male portion provided at the battery, and the second connector block having a second contact having elasticity with a third contact portion and a fourth contact portion facing the third contact portion, wherein when the second connector block is engaged with the first connector block, the third contact portion is pressed against the first contact portion and the fourth contact portion is pressed against the second contact portion by the elasticity of the second contact.

DESCRIPTION OF THE PREFERRED EMBODIMENT

The present invention will be explained below based on the drawings showing one embodiment thereof.

Figure 1:
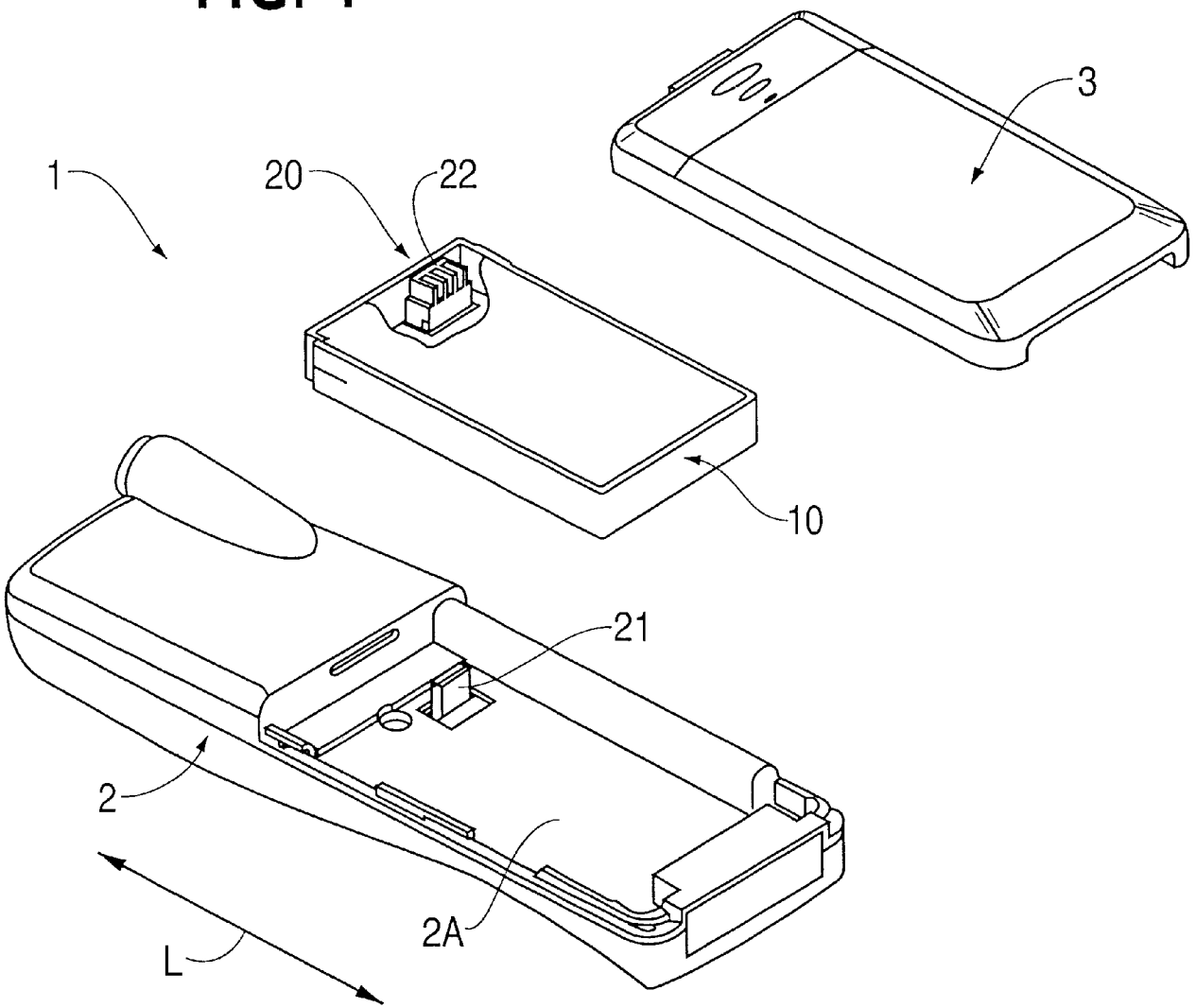
FIG. 1 is an exploded perspective view showing a radio communication equipment (portable telephone) according to a first embodiment of the invention.
Figure 2:
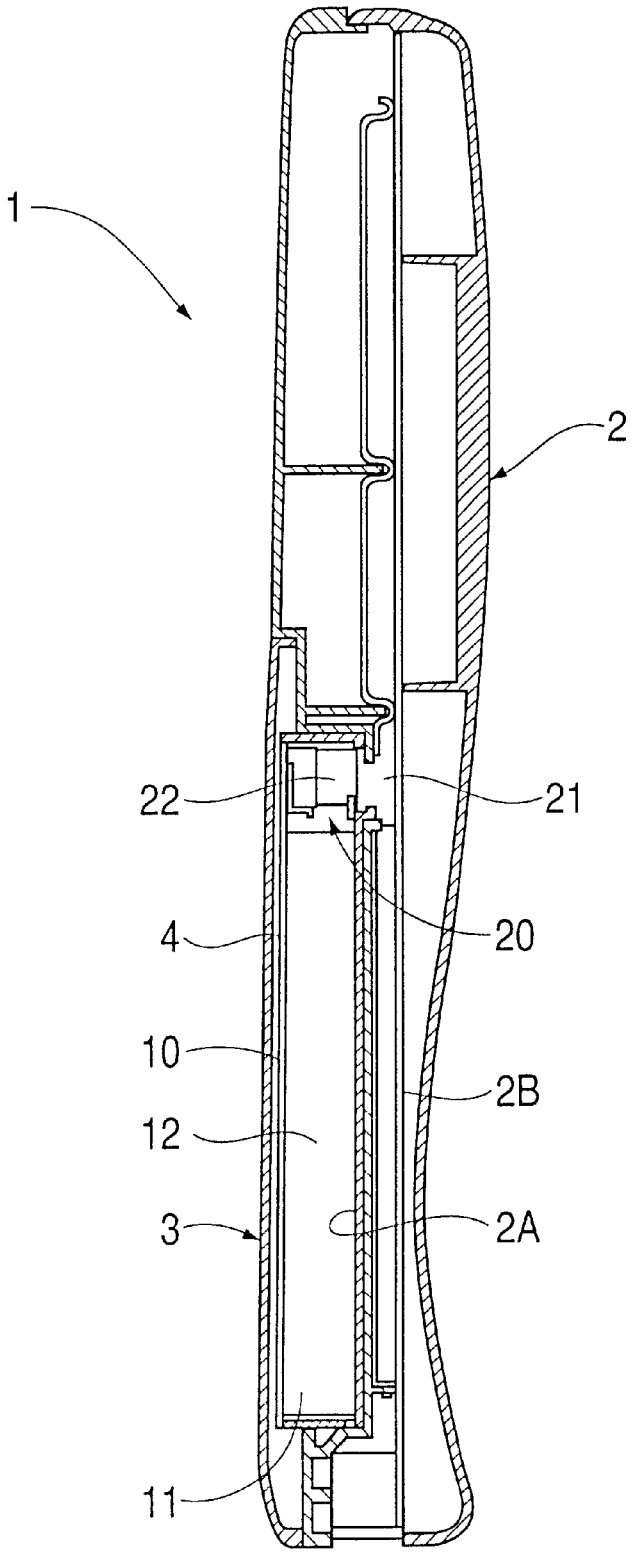
FIG. 2 is a section view showing the radio communication equipment of the invention.

FIGS. 1 through 5 show a portable telephone 1 as a radio communication equipment to which the invention is applied. As shown in FIGS. 1 and 2, the portable telephone 1 comprises a telephone housing (housing of the communication equipment) 2, a lid 3 and a battery pack 10.

The telephone housing 2 is provided with control buttons and others not shown on the front side (on the right side in FIG. 2) and a battery storing recess 2A on the back side (on the left side in FIG. 2). A battery compartment 4 is comparted by the lid 3 which is attached to the telephone housing 2 so as to cover the battery storing recess 2A and the battery pack 10 is stored in the battery compartment 4.

A male connector (one connector) 21 composing a floating connector 20 described later for electrically connecting the telephone housing 2 with the battery pack 10 is fixedly provided on a circuit board 2B so as to protrude to the battery storing recess 2A in the telephone housing 2.

Meanwhile, the battery pack 10 contains a battery cell 12 within a casing 11 thereof and a female connector (the other connector) 22 composing the floating connector 20 is fixedly provided within the casing 11 so as not protrude out of the casing 11 in the battery pack 10.

L represents a longitudinal direction of the portable telephone 1.

Figure 3:
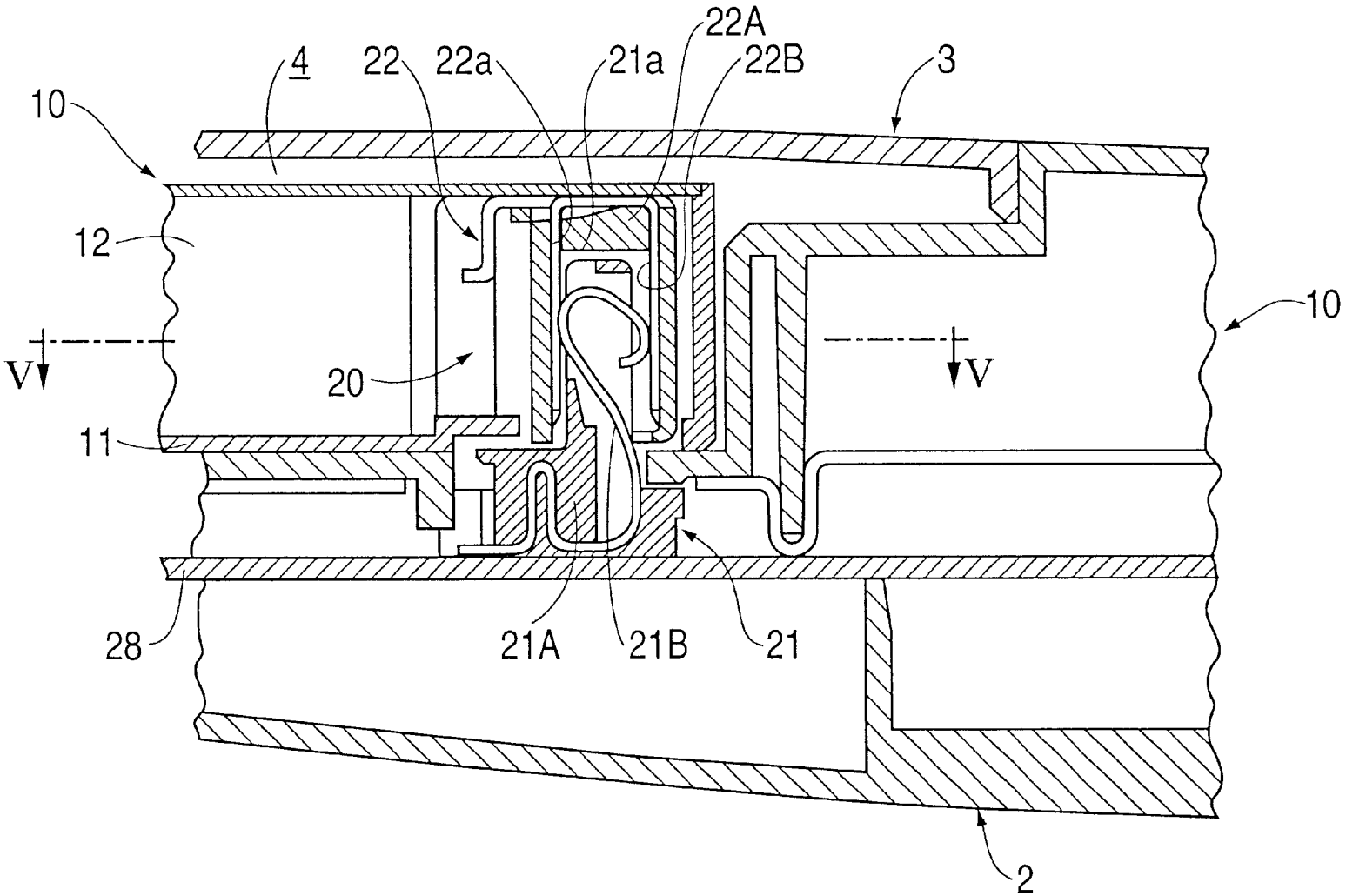
FIG. 3 is a section view showing the main part of a floating connector of the inventive radio communication equipment.
Figure 4:
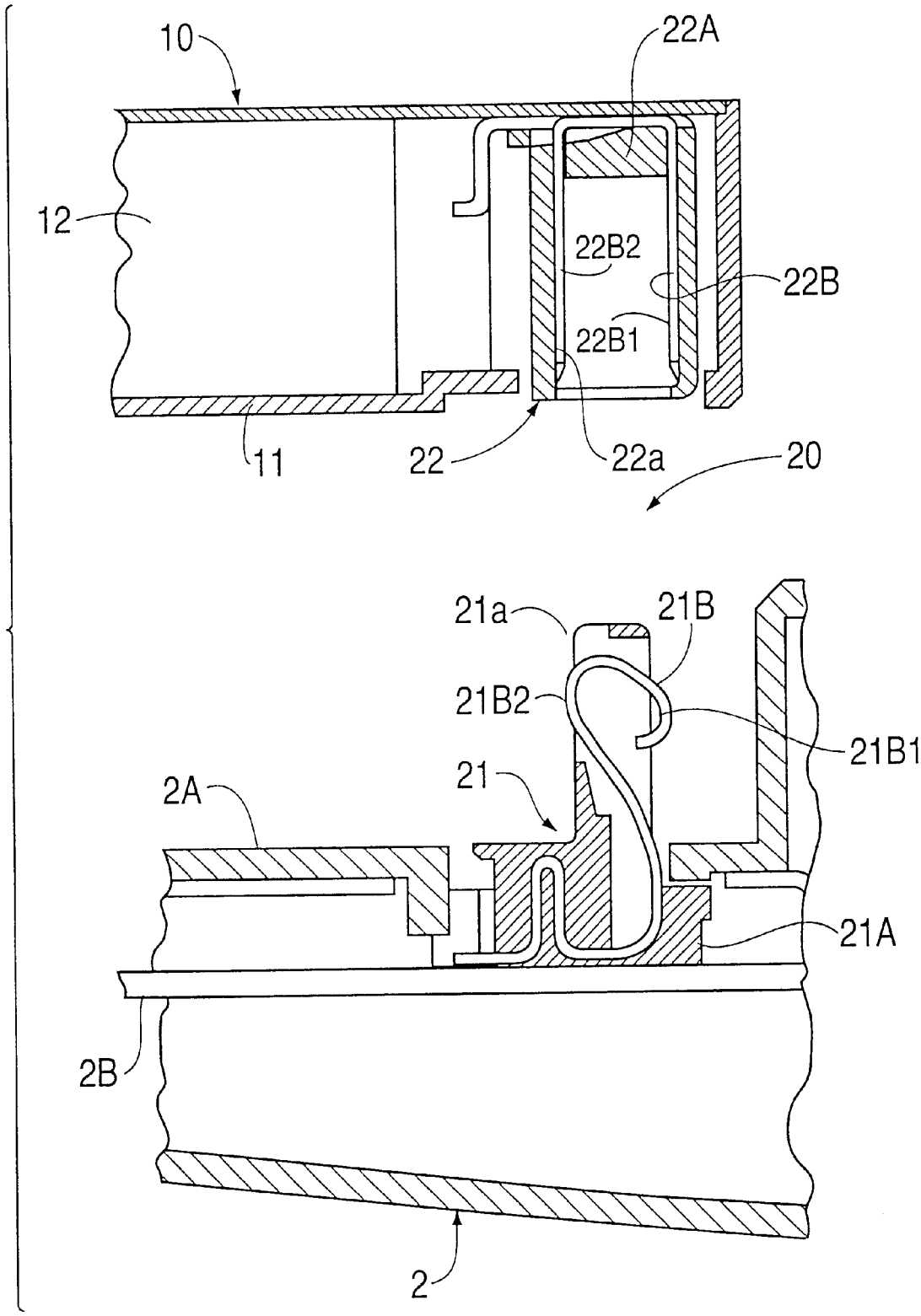
FIG. 4 is a section view showing the main part of the floating connector of the inventive radio communication equipment.
Figure 5:
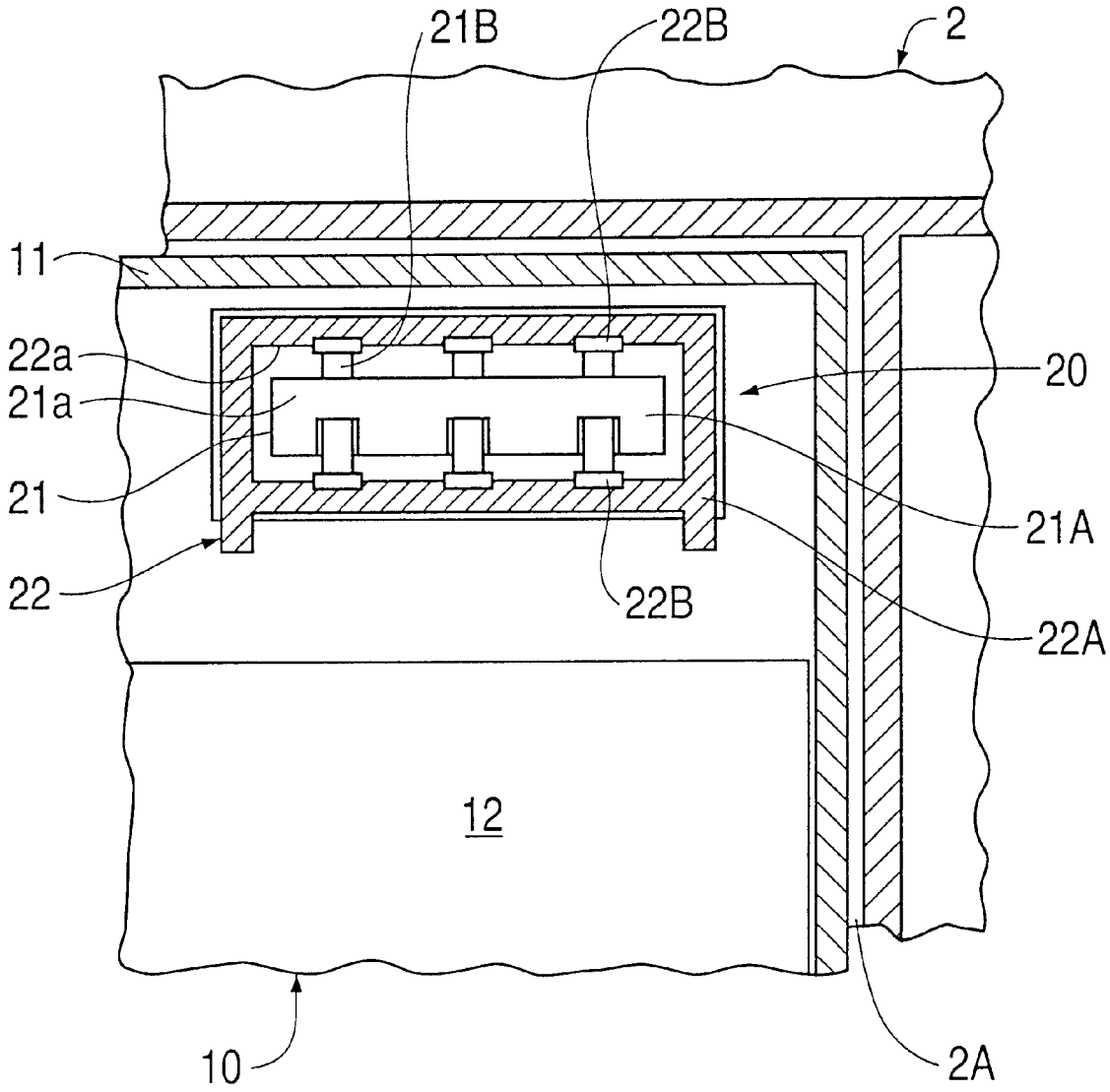
FIG. 5 is a section view taken along a line V—V in FIG. 3.

As shown in FIGS. 3 through 5, the male connector 21 of the floating connector 20 has a connector block 21A having a convex portion 21*a* and cantilever type contacts 21B which extend along the convex portion 21*a* and the convex portion 21*a* of the connector block 21A is provided so as to protrude to the back side (upper side in FIGS. 3 and 4) of the telephone housing 2. The convex portion 21*a* of the connector block 21A elongates in a vertical direction against the longitudinal direction L of the portable telephone.

Meanwhile, the female connector 20 has a connector block 22A having a concave portion 22*a* and contacts 22B provided so as to face to the concave portion 22*a* and the concave portion 22*a* of the connector block 22A is provided so as to face to the convex portion 21*a* of the male connector 21 provided on the telephone housing 2.

In the portable telephone 1 constructed as described above, the battery pack 10 is mounted by storing the battery pack 10 in the battery storing recess 2A from the back of the telephone housing 2 while engaging the male connector 21 with the female connector 22 in the telephone housing 2 from which the lid 3 is removed and then by attaching the lid 3 to telephone housing 2. The contact 22B includes a first contact portion 22B1 and a second contact portion 22B2 facing the first contact portion 22B1.

The contact 21B includes a third contact portion 21B1 and a fourth contact portion 21B2 facing the third contact portion 21B1. The third contact portion 21B1 is pressed against the first contact portion 22B1 and the fourth contact portion 21B2 is pressed against the second contact portion 22B2.

Therefore, the telephone housing 2 is connected electrically with the battery pack 10 when the contact 21B of the male connector 21 press contacts the contact 22B of the female connecter 22 by its elastic force when the male connector 21 is engaged with the female connector 22 in the floating connector 20 as shown in FIGS. 3 and 5.

Further, a clearance is created, though it is very small (about +0.5 mm), between the convex portion 21*a* of the connector block 21A of the male connector 21 and the concave portion 22*a* of the connector block 22A of the female connector 22 in the state when the male connector 21 is engaged with the female connector 22 so that the male connector 21 and the female connector 22 can move relatively in the three directions of in front and in rear, right and left and up and down and so that the third contact portion 21B1 abuts with the first contact portion 22B1 and the fourth contact portion 21B2 abuts with the second contact portion 22B2.

Therefore, when vibration is applied from the outside, the relative move of the telephone housing 2 and the battery pack 10 is absorbed in the floating connector 20 in the portable telephone 1 constructed as described above, so that it is possible to prevent the instantaneous disconnection of the electrical connection between the telephone housing 2 and the battery pack 10 caused by the vibration.

Even if the battery pack is moved in the direction of in right and left by the vibration, the contact 21B of the male connector 21 always abuts with the contact 22B of the female connector 22 by elasticity of the contact 21B at the portions 21B1, 21B2. Therefore, it is possible to prevent the instantaneous disconnection of electrical connection between the telephone housing 2 and the battery pack 10.

Even if the battery pack is moved in the direction of in up and down by the vibration, the contact 21B of the male connector 21 abuts with the contact 22B of the female connector 22 by elasticity of the contact 21B. Therefore, it is possible to prevent the instantaneous disconnection of electrical connection between the telephone housing 2 and the battery pack 10.

Further, because the telephone housing 2 is connected electrically with the battery pack 10 in the portable telephone 1 constructed as described above by using the floating connector 20 which is far durable than the connector used in the personal handy phone, there will be no problem in terms of the durability of the floating connector 20 even when the portable telephone is used by replacing the battery pack 10 frequently.

Still more, because the female connector 22 is fixedly provided to the casing 11 of the battery pack 10 in the portable telephone 1 constructed as described above, the work for connecting/disconnecting the male connector 21 to/from the female connector 22, i.e., the work for attaching/removing the battery pack 10 to/from the telephone housing 2, may be facilitated compared to the prior art structure in which the connector is attached to the battery pack via the harness.

Moreover, because the female connector 22 is not protruding out of the casing 11 of the battery pack 10 in the portable telephone 1 constructed as described above, it is not only easy to carry the battery pack 10 but is also possible to prevent the problem of unintentional disconnection of the wire connecting the battery cell 12 with the female connector 22 from occurring.

Still more, because the lid 3 which composes the appearance together with the telephone housing 2 is constructed separately from the battery pack 10 in the portable telephone 1 constructed as described above, it is not necessary to change the specification of the battery pack 10 and hence is possible to standardize the battery pack 10 even when the design thereof such as color variation of the appearance is different.

Figure 6:
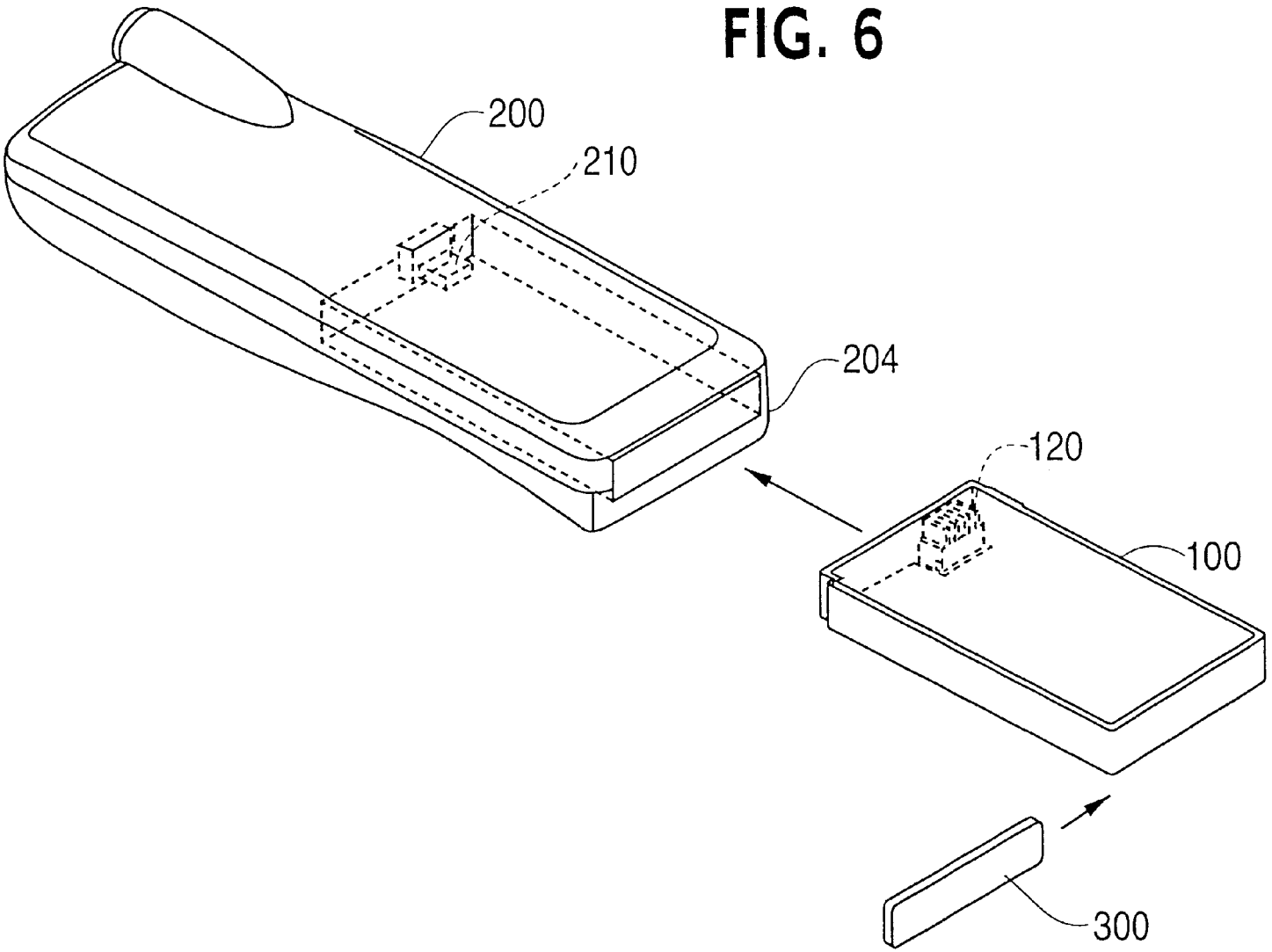
FIG. 6 is a perspective view showing a radio communication equipment according to a second embodiment of the invention.
Figure 7:
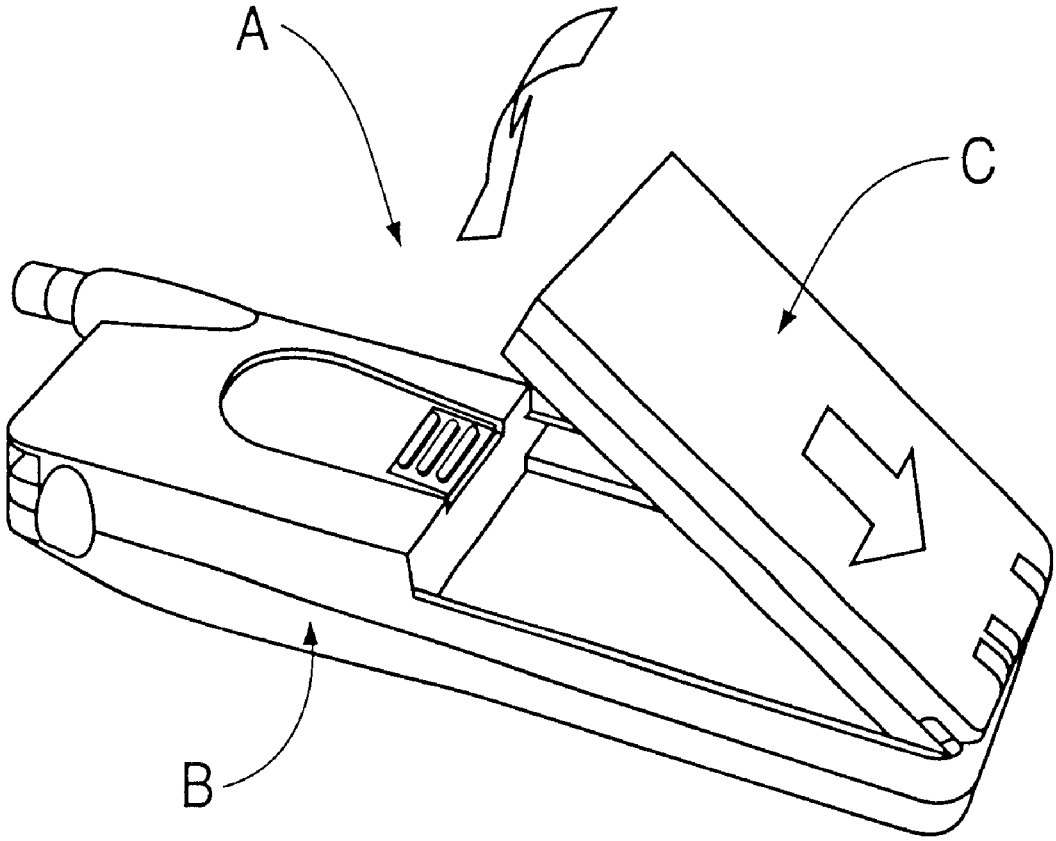
FIG. 7 (PRIOR ART)
FIG. 7 is a perspective view of an appearance of a prior art radio communication equipment.
Figure 8:
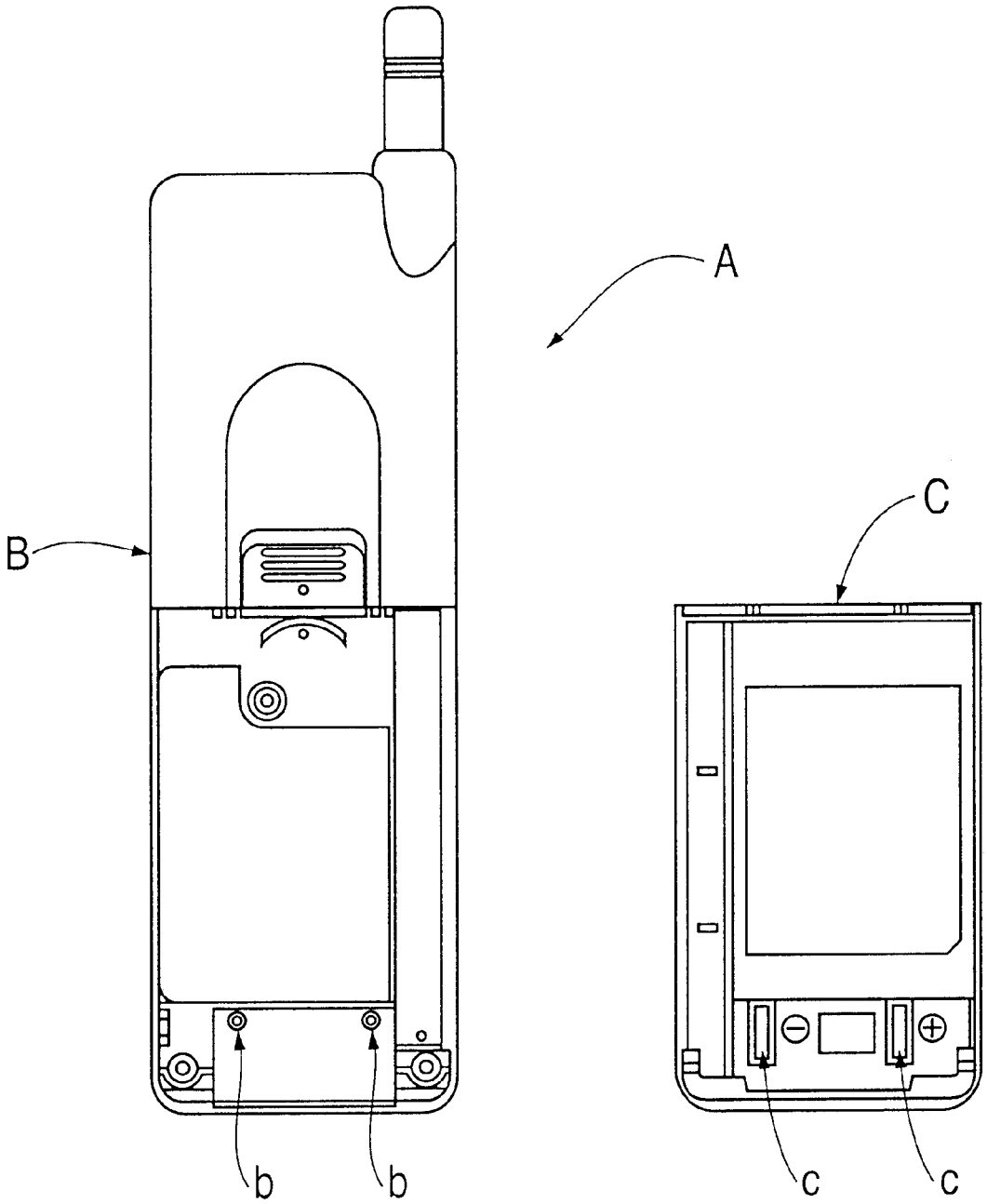
FIG. 8 (PRIOR ART)
FIG. 8 is an appearance of a housing and a battery pack of the prior art radio communication equipment.
Figure 9:
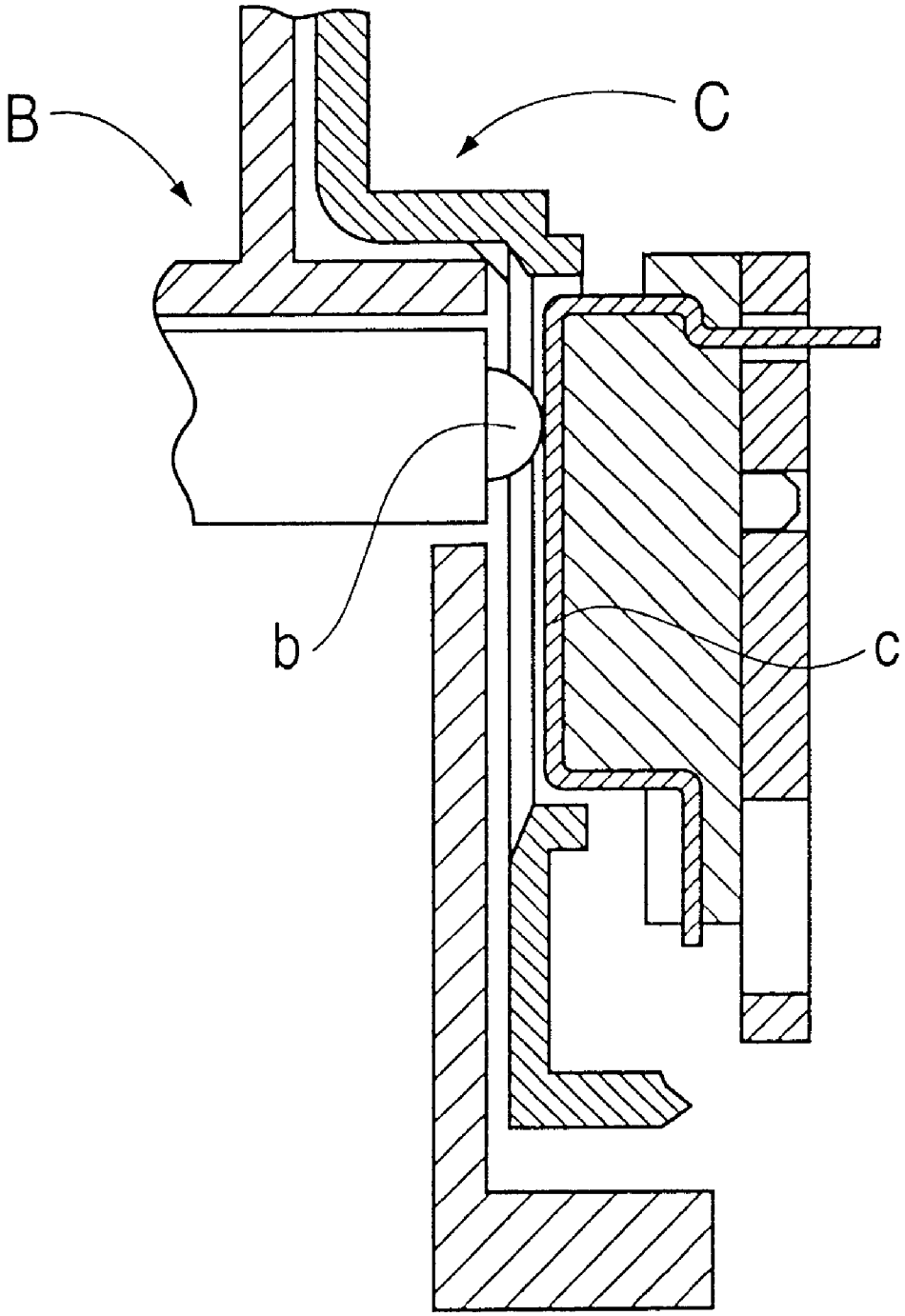
FIG. 9 (PRIOR ART)
FIG. 9 is a section view showing the main part of spring pins and terminals of the prior art radio communication equipment.
Figure 10:
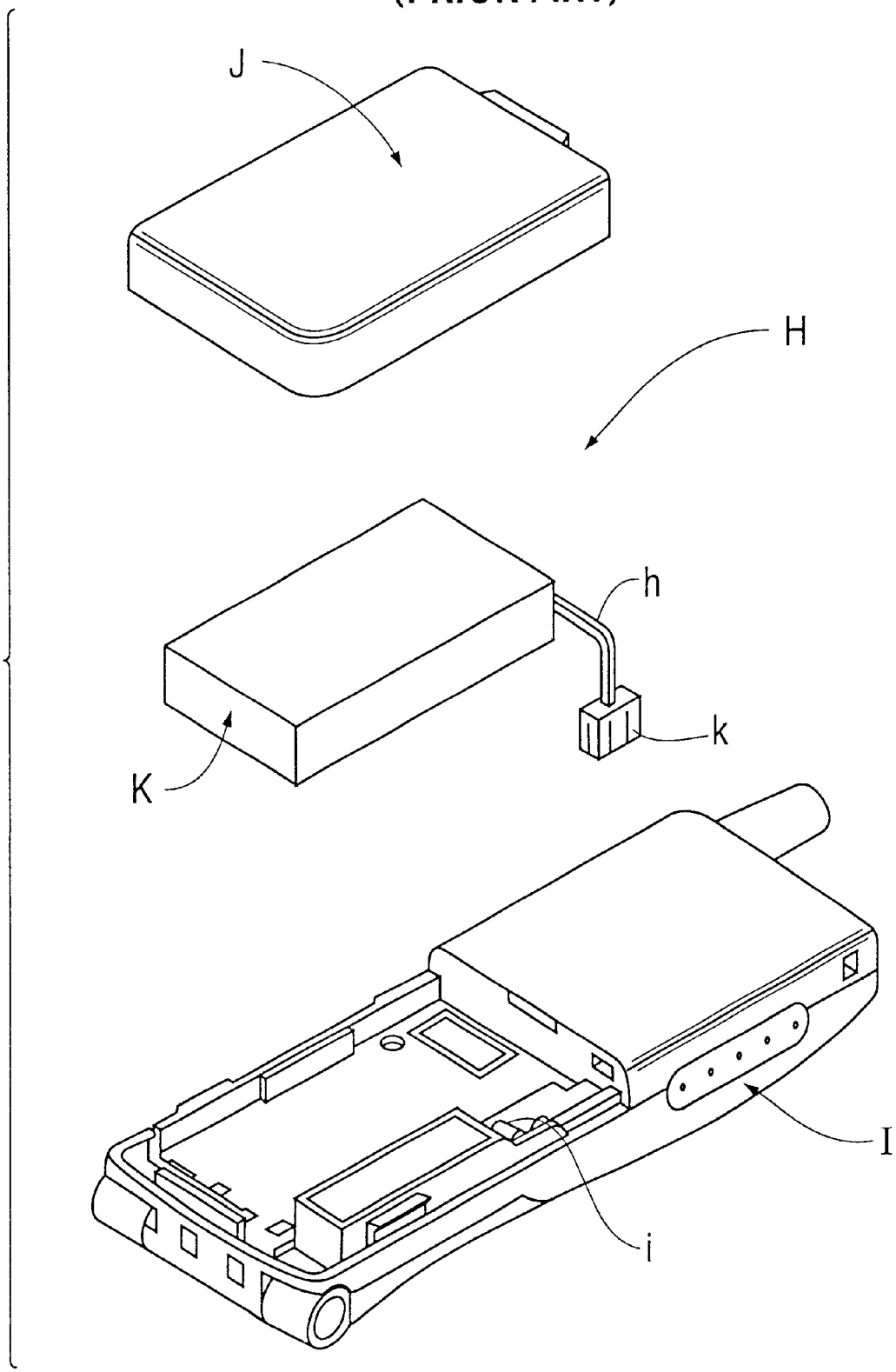
FIG. 10 (PRIOR ART)
FIG. 10 is an exploded perspective view showing another prior art radio communication equipment.

It is noted as for the mode of connection of the housing and the battery pack that an opening 204 leading to the battery storing recess may be created at the end face of a housing 200 of the portable telephone so that a battery pack 100 can be inserted from the end face as shown in FIG. 6 as another embodiment.

A male connector 210 which is the same with the male connector of the floating connector used in the first embodiment is provided in the battery storing recess so as to extend in parallel with the longitudinal direction of the telephone housing. Meanwhile, a female connector 120 which is to be connected with the male connector 210 is provided at the end face of the battery pack 100 as shown in the figure.

Thereby, the male and female connectors 210 and 120 of the floating connector engage by inserting the battery pack 100 to the housing 200 in the direction shown in the figure. Then, the battery pack may be connected with the telephone housing via the floating connector so that the battery pack will not be separated from the telephone housing by attaching a lid 300 to the housing 200 so as to close the opening 204 of the housing 200.

It is noted that although the portable telephone has been illustrated in the embodiments described above, it is needless to say that the invention may be effectively applied not only to the portable telephone but also to various radio communication equipments. Although the contact portions 21B1, 21B2 are provided on the contact 21B, three contact portions may be provided on the contact 21B.

We claim:

1. A radio communication equipment having a battery compartment and a battery pack provided in the battery compartment, the equipment comprising:

a first connector block having a female portion provided at the battery pack, the first connector block having a first contact with a first contact portion and a second contact portion facing the first contact portion; and a second connector block having a male portion provided at the battery compartment, the second connector block having a second contact having elasticity in a first direction with a third contact portion and a fourth contact portion facing the third contact portion, wherein the second connector block is engaged with the first connector block in a second direction intersecting the first direction, and the third contact portion is pressed against the first contact portion and the fourth contact portion is pressed against the second contact portion by the elasticity of the second contact.

2. The equipment of claim 1, wherein the second connector block is provided so as to elongate in a vertical direction relative to a longitudinal direction of the equipment.

3. The equipment of claim 1, wherein the first connector block is provided at an upper surface of the battery pack, and the second connector block is provided so as to elongate in a parallel direction relative to a longitudinal direction of the equipment.

4. The equipment of claim 1, wherein when the second connector block is engaged with the first connector block, clearance is provided between the second connector block and first connector block.

5. The equipment of claim 1, wherein the battery compartment has a bottom surface and the second contact is provided so as to elongate in a vertical direction relative to the bottom surface.

6. The equipment of claim 1, wherein the battery compartment has a bottom surface and the second contact is provided so as to elongate in a parallel direction relative to the bottom surface.

7. The equipment of claim 1, wherein the second contact includes an S-shaped conductive cantilever with the third and fourth contact portions.

8. A battery pack for use in a radio communication equipment with a battery compartment, the battery compartment provided with a male connector, comprising:

a female connector block having a first contact with a first contact portion and a second contact portion facing the first contact portion, wherein the male connector block includes a second contact having elasticity in a first direction with a third contact portion and a fourth contact portion, and when the male connector block is engaged with the female connector block in a second direction intersecting the first direction, the third contact portion is pressed against the first contact portion and the fourth contact portion is pressed against the second contact portion by the elasticity of the second contact.

9. The battery pack of claim 8, wherein the first contact is provided so as to elongate in a vertical direction relative to a longitudinal direction of the equipment when the male connector block is engaged with the female connector block.

10. The battery pack of claim 8, wherein the first contact is provided so as to elongate in a parallel direction relative to a longitudinal direction of the equipment when the male connector block is engaged with the female connector block.

11. The battery pack of claim 8, wherein the battery compartment has a bottom surface and the first contact is provided so as to elongate in a vertical direction relative to the bottom surface when the male connector block is engaged with the female connector block.

12. The battery pack of claim 8, wherein the battery compartment has a bottom surface and the first contact is provided so as to elongate in a parallel direction relative to the bottom surface when the male connector block is engaged with the female connector block.

13. A connector for use in connecting a circuit of a radio communication equipment with a battery pack, the radio communication equipment having a battery compartment, the battery pack being provided in the battery compartment, the connector comprising:

a first connector block having a female portion provided at the battery pack, the first connector block having a first contact with a first contact portion and a second contact portion facing the first contact portion; and a second connector block having a male portion provided at the battery compartment, the second connector block having a second contact having elasticity in a first direction with a third contact portion and a fourth contact portion facing the third contact portion, wherein when the second connector block is engaged with the first connector block in a second direction intersecting the first direction, the third contact portion is pressed against the first contact portion and the fourth contact portion is pressed against the second contact portion by the elasticity of the second contact.

14. The connector of claim 13, wherein the second connector block is provided so as to elongate in a vertical direction relative to a longitudinal direction of the equipment.

15. The connector of claim 13, wherein the first connector block is provided at an upper surface of the battery pack, and the second connector block is provided so as to elongate in a parallel direction relative to a longitudinal direction of the equipment.

16. The connector of claim 13, wherein when the second connector block is engaged with the first connector block, clearance is provided between the second connector block and first connector block.

17. The connector of claim 13, wherein the battery compartment has a bottom surface and the second contact is provided so as to elongate in a vertical direction relative to the bottom surface.

18. The connector of claim 13, wherein the battery compartment has a bottom surface and the second contact is provided so as to elongate in a parallel direction relative to the bottom surface.

19. The connector of claim 13, wherein the second contact includes an S-shaped conductive cantilever with the third and fourth contact portions.

20. A connector for use in connecting a circuit of a radio communication equipment with a battery pack, the radio communication equipment having a battery compartment, the battery pack being provided in the battery compartment, the connector comprising:

a first connector block having a female portion provided at the battery pack, the first connector block having a first contact with a first contact portion and a second contact portion facing the first contact portion; and a second connector block having a male portion provided at the battery compartment, the second connector block having a second contact having elasticity in a first direction with a first surface and a second face facing the first surface, the first surface including a third contact portion and the second surface including a fourth contact portion, wherein when the second connector block is engaged with the first connector block in a second direction intersecting the first direction, the third contact portion is pressed against the first contact portion and the fourth contact portion is pressed against the second contact portion by the elasticity of the second contact.

* * * * *